US005100072A

United States Patent [19]

Behrens et al.

[11] Patent Number: 5,100,072

[45] Date of Patent: Mar. 31, 1992

[54] YARN WINDING APPARATUS AND METHOD

[75] Inventors: Reinhard Behrens; Hans-Jochen Busch; Siegmar Gerhartz; Erich Lenk, all of Remscheid; Hermann Westrich, Wuppertal, all of Fed. Rep. of Germany

[73] Assignee: Barmag AG, Remscheid, Fed. Rep. of Germany

[21] Appl. No.: 603,936

[22] Filed: Oct. 25, 1990

Related U.S. Application Data

[63] Continuation-in-part of Ser. No. 454,723, Dec. 21, 1989, Pat. No. 5,029,762.

[30] Foreign Application Priority Data

Jun. 6, 1990 [DE] Fed. Rep. of Germany ..... 4018095
Jun. 15, 1990 [DE] Fed. Rep. of Germany ..... 4019095

[51] Int. Cl.[5] ..... B65H 67/048; B65H 54/42; B65H 54/52

[52] U.S. Cl. ..... 242/18 A; 242/18 R; 242/18 DD

[58] Field of Search ..... 242/18 A, 18 DD, 18 PW, 242/18 R

[56] References Cited

U.S. PATENT DOCUMENTS 3,841,574 10/1974 Lenk et al. ..... 242/18 DD
3,985,313 10/1976 Klein et al. ..... 242/18 A X
4,106,710 8/1978 Schippers et al. ..... 242/18 R
4,145,010 3/1979 Turk et al. ..... 242/18 A
5,016.829 5/1991 Schippers et al. ..... 242/18 A

FOREIGN PATENT DOCUMENTS 2544773 4/1977 Fed. Rep. of Germany .
3207375 10/1982 Fed. Rep. of Germany .

*Primary Examiner*—Stanley N. Gilreath
*Attorney, Agent, or Firm*—Bell, Seltzer, Park & Gibson

[57] ABSTRACT

A winding apparatus is disclosed which includes a rotatable revolver having at least one spindle mounted thereon, with the spindle being adapted to coaxially mount one or more bobbin tubes. The revolver is rotatably mounted to the frame of the apparatus by a circular bearing surface of substantial diameter, which provides a very stable and durable mounting. The apparatus also includes a traversing mechanism for traversing an advancing yarn and so as to form a cross wound package on the tubes at the winding position. Also, a contact roll is mounted between the traversing mechanism and the winding position so as to be adapted to rest upon the surface of the package being formed. The contact roll is movable a limited distance radially away from the package being wound, and its position is sensed. To accommodate the build of the package, the revolver is positively rotated in response to the sensed position of the contact roll and so that the distance between the axes of the contact roll and the spindle is increased and the pressure between the contact roll and the package may be maintained within a small range of variation.

24 Claims, 10 Drawing Sheets

YARN WINDING APPARATUS AND METHOD

REFERENCE TO RELATED APPLICATION

This is a continuation-in-part of copending application Ser. No. 07/454,723, filed Dec. 21, 1989, now U.S. Pat. No. 5,029,762.

BACKGROUND OF THE INVENTION

The present invention relates to a yarn winding apparatus of the type having a rotatable turret or revolver which mounts at least one winding spindle, and wherein a contact roll is positioned to rest upon the package being formed on the spindle. The invention also relates to a method of doffing the apparatus.

A winding apparatus of the described type is known, and wherein relative movement between the contact roll and the winding spindle is carried out by the rotation of the revolver as the package diameter increases, note for example from German OS 32 07 375.

In such known winding apparatus, the contact roll is rigidly supported by the machine frame. The winding spindle is mounted on a rocker arm, which is pivotally supported on the revolver, so that the winding spindle can occupy an outer and an inner radial position relative to the revolver. However, this design lacks of the stability which is necessary for high package weights and high yarn speeds.

DE-OS 25 44 773 discloses a winding apparatus, in which the winding spindle is supported in a movable slide. The contact roll is supported in a likewise movable support. The slide of the winding spindle is held by pneumatic cylinders, which are biased by pressure as a function of the movement of the support of the contact roll, thereby compensating for the weight of the slide with the winding spindle and the package. As the package diameter increases, the pressure which is exerted in the cylinders is reduced in such a manner that the slide lowers by its own weight. In so doing, the so-called stick-slip effects are unavoidable.

Likewise, the support of the spindle on a translatorily movable slide creates significant problems with regard to the stability and service life of the slide guidance.

It is accordingly an object of the present invention to provide a yarn winding machine, wherein the spindle is rigidly supported so as to be free of vibrations, and is adapted to be moved in a controlled uniform manner, even with high package weights and high winding speeds.

It is also an object of the present invention to provide an efficient method of doffing an apparatus of the described type.

SUMMARY OF THE INVENTION

The above and other objects and advantages of the present invention are achieved in the embodiments illustrated herein by the provision of a winding apparatus which comprises a frame, and a revolver which has a circular bearing surface which defines a central axis. The revolver mounts at least one winding spindle which is adapted to mount at least one bobbin tube thereon and which defines a winding axis which is parallel to and radially spaced from the central axis. Also, the circular bearing surface is located radially beyond the rotational axis.

The apparatus also includes means mounting the revolver to the frame for rotation about the central axis and such that the winding spindle and associated bobbin tubes may be selectively moved between a winding position and a doffing position upon rotation of the revolver. The mounting means includes bearing means positioned between the circular bearing surface and the frame. Means for winding an advancing yarn onto a bobbin tube at the winding position is also provided and which includes means for rotating the spindle and associated bobbin tube at the winding position, and traversing means mounted at a location upstream of the winding position for traversing an advancing yarn to form a cross wound package.

The winding apparatus of the present invention also preferably includes a contact roll, and means mounting the contact roll to the frame at a location between the traversing means and the winding position and so as to be in circumferential contact with the package being wound, and so as to permit limited movement of the contact roll in a radial direction away from the package being wound at the winding position. Sensor means is provided for monitoring the radial movement of the contact roll and providing an output signal in response thereto, and rotary drive means is provided for selectively rotating the revolver to move the spindle between the winding position and the doffing position, and for causing rotation of the revolver in response to the output signal from the sensor means so as to increase the distance between the axis of the contact roll and the axis of the spindle at the winding position as the package builds and so that the positioning of the contact roll remains within a predetermined range during the course of the winding operation.

As indicated above, the present invention utilizes a revolver with an enlarged bearing surface, as opposed to the conventional rocking arm, and which preferably mounts a single winding spindle which is eccentric to the central axis of rotation of the revolver. The winding spindle is rotatable and can be driven by a coaxial motor, if need be. The spindle drive motor is positioned on the revolver, preferably on the back side thereof. The diameter of the circular bearing surface of the revolver is enlarged such that it is greater than the length of the actual rocking arm, i.e., greater than the spacing between the axis of rotation and the winding axis of the spindle. This structural configuration results in a very stable and durable bearing mount which is free of vibrations and easily movable. In the past, two spindles have been mounted on a revolver, which were alternately put into operation by rotating the revolver. However, in the case of a single winding spindle, its has always been customary to utilize the rocking arm principle or to use a slide movable in a straight line, when the winding spindle was not stationarily arranged.

A further feature of the present invention is that the revolver is no longer rotated, as was the case in the past, by the bearing load on the package, but it is positively rotated by a drive motor.

It should be emphasized that in the course of a winding cycle, the position of the contact roll remains substantially unchanged. This means that the contact roll performs in its support means only slight movements radially with respect to the winding spindle, in a range of few millimeters, preferably less than 1 mm. The relative movement necessary to adapt the spacing between the axis of the contact roll and the axis of the winding spindle to the increasing package diameter is effected by the rotation of the revolver during the winding cycle. This rotation is effected by a motor, which is controlled by a sensor. The sensor picks up the movement of the contact roll, in particular the distance covered by the support of the contact roll. As a result, the motor of the revolver is so controlled that the revolver rotates even at very small movements of the contact roll, each time to an extent that the winding spindle with an increasing package diameter makes way to the contact roll, whereas the contact roll barely leaves its initial position or returns to same again immediately.

The rotary drive motor associated with the revolver is actuated as a function of the output signal of the sensor, which picks up the deviation between an actual and a desired value of the position of the contact roll. The rotary drive can be stepwise actuated. To this end, a certain maximum value of the deviation between the actual and the desired value of the position of the contact roll is input, for example, programmed into the rotational control device. As long as the deviation is smaller than this input maximum value of the deviation, the rotational drive is braked, so that the revolver is unable to change its rotational position. If the actual deviation between the desired and actual value of the position of the contact roll is greater than the input maximum value, the brake will be released, and the revolver will be rotated at a predetermined speed until the deviation between the desired and actual value is again less than the input maximum value of the deviation.

In another method, the rotary drive is actuated by the rotational control device and the sensor such that the rotary drive is constantly in operation and rotates the revolver without interruption in such a manner that the deviation between the desired value and the actual value of the position of the contact roll is regulated down to a certain, low value.

The contact roll and its support as well as the winding spindle and the revolver with the rotary drive thus form, together with the rotational control device and the sensor, a control loop which allows the position of the contact roll to be substantially unchanged.

In contrast to all known winding machines, in the winding machine of the present invention, the distance between the axes of the contact roll and the winding spindle is not determined as a function of the contact pressure existing between the contact roll and the winding spindle, but by a rotary drive, which positively drives the revolver so as to increase the distance between the axes.

Stick-slip phenomena do not occur during a rotation of the revolver, since the latter is driven positively, i.e., forcibly. The amount of the contact pressure is determined solely by the force operative on the contact roll.

The winding machine of the present invention is used preferably for winding freshly spun manmade fibers in spinning installations. In the design of the winding machine, the revolver rotates in the same direction as the spindle.

In a preferred embodiment, the contact pressure first increases. This means, at the beginning of a winding cycle, the yarn is wound at a low contact pressure, thereby preventing damage to the first layers of the yarn. Furthermore, it is possible to keep the change of the contact pressure small. To this end, the support of the contact roll as well as the center of rotation of the revolver and the turning circle in which the spindle axis is located, as well as the radius of the contact roll are arranged relative to each other such that at the desired maximum diameter ratio, the change of the pressure of the contact roll on the package remains within the desired limits during a winding cycle. The diameter ratio is here understood to be the quotient of the diameter of the winding spindle at the beginning of a winding cycle (empty tube) over the diameter of the winding spindle at the end of a winding cycle (full package). This operating diameter ratio amounts to at least 1:3 in modern winding machines. In any event, the allowed change of the radial contact pressure is less than 50%, with the contact pressure starting at a low value and being allowed to first increase at the most. Preferably, the radial force exerted by the contact roll on the package will change by no more than about 10% in the course of a winding cycle, and preferably by no more than 5% after the first layers of yarn are wound.

The winding machine of the present invention operates in such a manner that as the package diameter increases, the revolver is rotated in the same direction as the winding spindle. The winding spindle is driven by an axial drive motor.

As noted above, the present invention makes it possible to keep the contact pressure constant within a small range, which is insignificant from the viewpoint of the winding technology, between the contact roll and the winding spindle or package, while the latter is wound.

In the winding of manmade fibers, for which the winding machine is primarily intended, the yarn typically advances in general from the top to the bottom. Since the contact roll is arranged between a yarn traversing mechanism and the winding spindle, both the support and the contact roll are weighted by a component of gravity. Additional measures permit the radially operative bearing load between the contact roll and the package to be adjusted to a degree allowable from the viewpoint of the winding technology. A pressure relief device may, for example, be a biasing means for a constant force, such as a spring or a pneumatic or hydraulic cylinder-piston assembly, which is biased by a constant pressure.

In the case of technologically difficult winding problems, it will also be possible to control, for example, a hydraulic or pneumatic pressure relief device in accordance with the desired course of the contact pressure during a winding cycle.

If the contact pressure roll is supported such that it does not rest on the package by its gravity, but free thereof, a weighting device, for example, a hydraulic or pneumatic cylinder-piston assembly will be provided, which is operative on the support of the contact roll and produces the necessary contact pressure, it being possible to design the weighting device such that it produces a constant contact pressure. However, it is also possible to design the weighting device such that in the course of a winding cycle the contact pressure is controlled in accordance with a certain programmed pattern.

The support which carries the contact roll is preferably a rocker arm, which is pivotally supported on one end by the machine frame, and the other end of which holds the contact roll. If the contact roll is to rest on the package by its own weight, the rocker arm will be arranged horizontally or obliquely. If the contact roll is to rest on the package without the influence of its weight, the rocker arm will have to be arranged substantially vertically.

In the preferred embodiment, the rocker arm which supports the contact roll is in turn supported in a rubber or elastic bushing which is fixed to the machine frame. This provides a wear-resistant suspension, which has the advantage that the pivotal motion of the contact roll is subjected to a force which increases along with the deflecting movement. Consequently, it becomes possible to adjust for the zero setting of the contact roll a position which is stable in the course of the winding cycle, without incurring any regulating problems. The rubber bushing suspension also has the advantage, that the rubber bushing not only allows a pivotal motion within the range of slight measuring deflections of the contact roll, but it also allows a movement perpendicular thereto, i.e., on the connecting line between the axis of rotation and the axis of the contact roll. This permits the contact roll to align itself parallel to the axis of the winding spindle both in the pivotal direction and vertically thereto. Of special importance is also the fact that the rubber bushing dampens the movement of the contact roll.

The yarn traversing mechanism of the present invention may be a known design, such as in particular a rotary blade traversing system as disclosed in EP-B 111,642, a traversing system employing a cross-spiralled roll, as is known from U.S. Pat. No. 3,664,596, a traversing system employing a grooved roll, as is disclosed in U.S. Pat. No. 3,797,767, or other yarn traversing systems. The yarn traversing mechanism may be fixedly mounted to the machine frame.

As is known, the yarn looping about the contact roll is deposited on the contact roll in accordance with the law of reciprocation of the traversing mechanism, the stroke reversal being dependent on the spacing between the traversing mechanism and the contact line of the yarn on the contact roll. Any change of this spacing will be incorporated in the law of yarn deposit.

In one preferred embodiment of the invention, the distance between the traversing mechanism and the contact roll does not change in the course of a winding cycle, despite the slight movement of the contact roll. To this end, it is preferred to likewise mount the traversing mechanism on a rocker arm, which is supported either coaxially with the rocker arm of the contact roll or pivotally on the rocker arm of the contact roll. This arrangement will make it possible to lift the traversing mechanism from the contact roll for servicing, so that both the contact roll and the traversing system are easily accessible.

With the above construction, the traversing mechanism is prevented from also performing a movement perpendicular to the yarn path during its relative movement to the contact roll. This is especially important, when a drive mechanism is provided which is operative on the support of the traversing system, and which permits the spacing between the contact roll and the traversing system to be varied in the course of a winding cycle. Thus, the invention makes it also possible to operate with a variable traverse stroke during the winding cycle. To this end, the drive mechanism may be controlled by a predetermined program. A corresponding program allows to shorten the stroke during a winding cycle, in particular at its beginning. In this respect, reference is made to the package formation disclosed in U.S. Pat. No. 4,789,112. Furthermore, it is made possible by a corresponding program to carry out a stroke modification, such as is disclosed, for example, in U.S. Pat. No. 4,325,517 and DE-OS 37 23 524 A1. Likewise, it is possible to axially and periodically reciprocate the traversing mechanism relative to the contact roll, so as to effect in this manner a displacement of the stroke.

To doff a package, the contact roll can perform a slight evading movement so as not to impede the empty tube moving to its operating position. In so doing, use is made of the mobility of the contact roll, which serves within the scope of the present invention to control or regulate the rotary drive of the revolver in the course of a winding cycle as a function of the increasing package diameter. However, this function is ineffective while the first layers of yarn are formed on the empty tube.

For the purpose of doffing a package, it is preferable to further rotate the revolver, so that the package is released from the contact roll. To return the winding spindle to its initial position in operation after a full package is removed and an empty tube is inserted, it is possible to rotate the revolver back to its initial winding position, either in the same direction or in the reverse direction.

The measuring function of the contact roll, by which an increasing package diameter is detected, can be reestablished after a certain programmed time has elapsed or after the full packages on the winding spindle in the idle or doffing position are replaced with empty tubes, in that the contact roll is lowered and put in contact with the winding spindle. Preferably however, a special control is unnecessary, and the measuring function of the contact roll is reestablished by the fact that, as the package diameter increases, there is again a contact between the package and the contact roll, which then results in the measurement of the deviation of the support arm of the contact roll.

It is preferred that during the contactless time, the contact roll is driven, preferably at a circumferential speed, which corresponds substantially to the nominal circumferential speed of the package. A suitable drive therefor is disclosed in DE-A 38 34 032.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENTS

Figure 1:
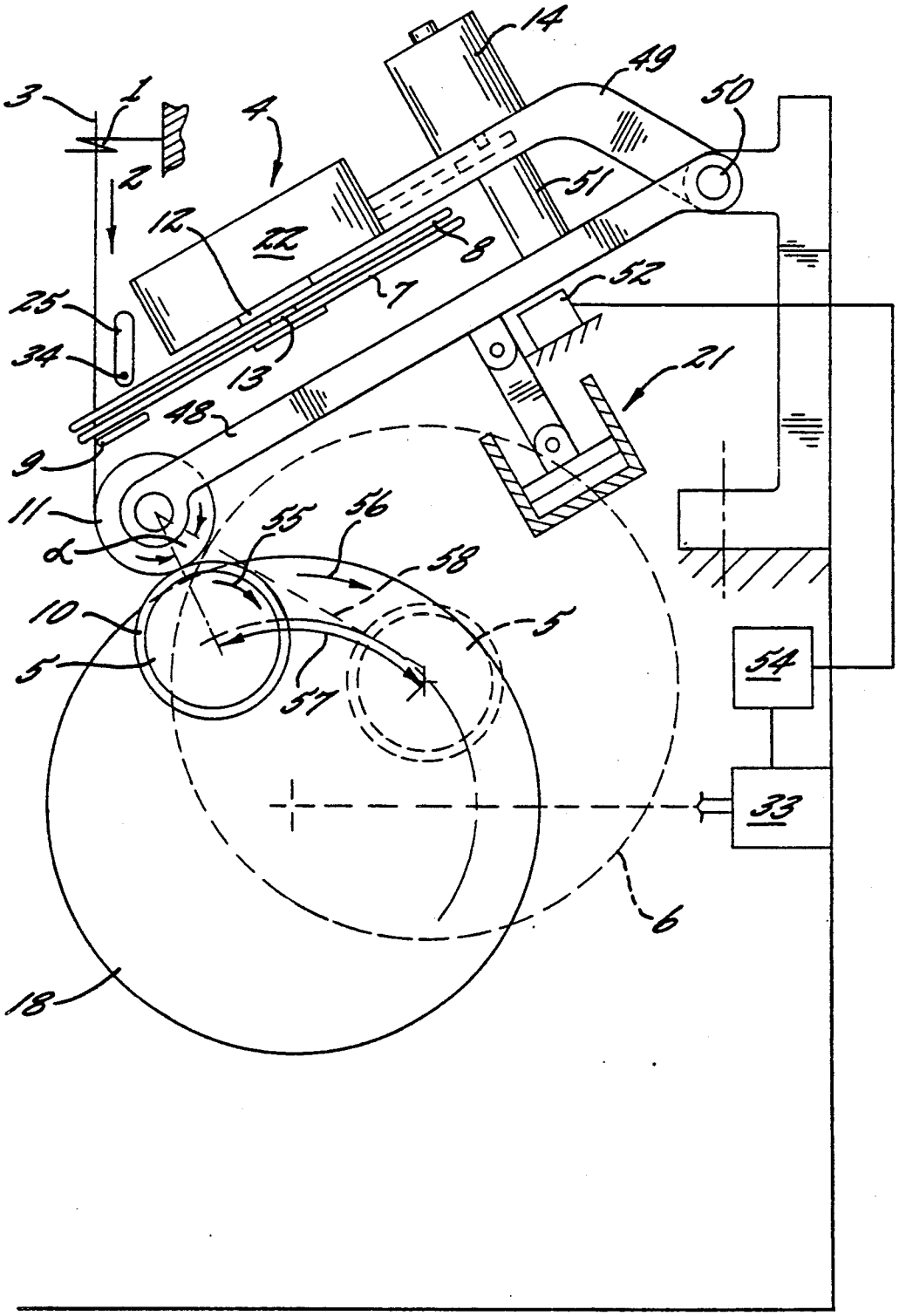
FIG. 1 is a side elevation view of a winding apparatus which embodies the present invention, and shown at the initial winding position.

The winding apparatuses, which are illustrated in FIGS. 1–4, differ from each other only in details. Consequently, the following description refers to all embodiments. Reference will be made to the different details as they arise.

The yarn feed system 17 (FIG. 2) of the apparatus continually advances a yarn 3 at a constant speed to the illustrated winding apparatus. The yarn is first guided through a yarn guide 1 which forms the apex of a traversing triangle. Then, as it moves in direction 2, the yarn reaches a traversing mechanism 4, which is described in more detail below. Downstream of the traversing mechanism, the yarn is deflected about a contact roll 11 by more than 90°, and then it is wound on a bobbin tube 10 to form a package 6.

Figure 2:
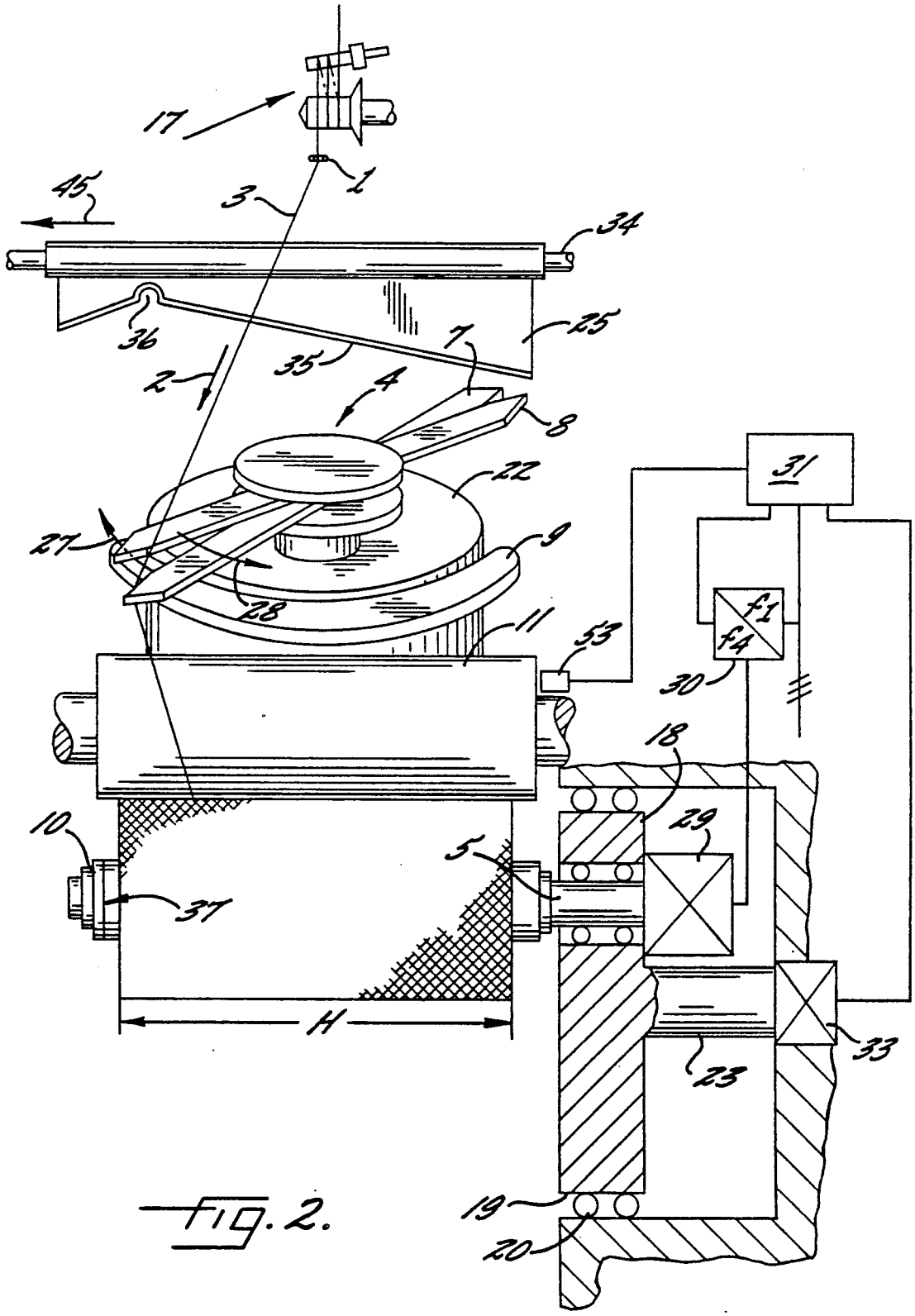
FIG. 2 is a front elevation view of the winding apparatus.
Figure 3:
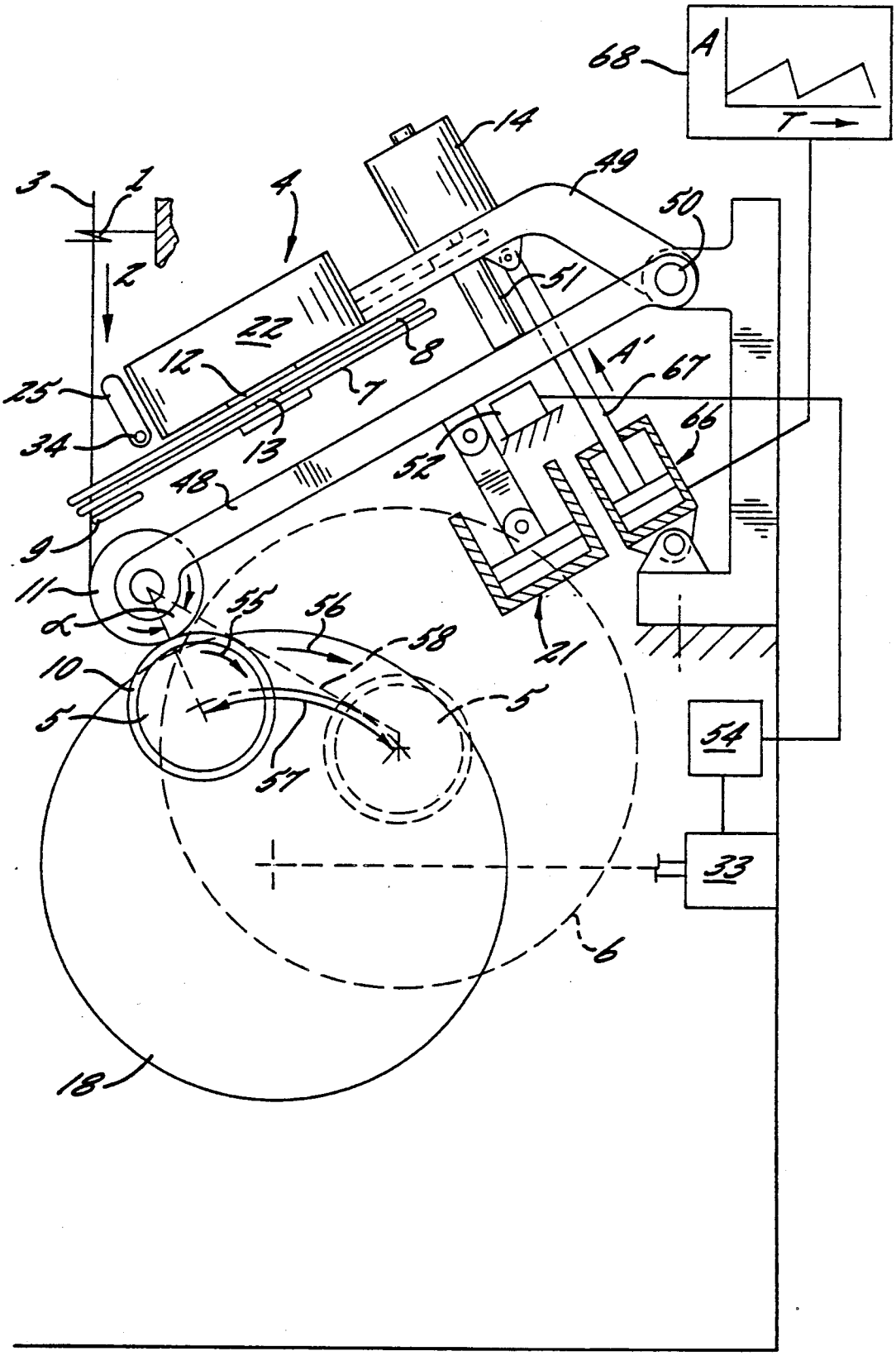
FIGS. 3 and 4 are side elevation views of embodiments, in which the spacing between the traversing mechanism and the contact roll is controllable.

A winding spindle 5 and a bobbin tube 10 placed thereon, are shown at the beginning of the winding operation in solid lines in FIGS. 1 and 3. The winding spindle 5 is rotatably supported in a rotatable turret or revolver 18. In all embodiments, the spindle 5 is driven by a synchronous motor 29, which is mounted on the revolver 18 in alignment with the spindle as schematically shown in FIG. 2. A frequency transmitter 30 supplies the synchronous motor with a three-phase current of a controllable frequency. The frequency transmitter 30 is in turn controlled by a controller 31, which is governed by a rotary speed sensor 53. The sensor 53 scans the speed of the contact roll and controls, via controller 31, the frequency transmitter 30 of the winding spindle 5 in such a manner that the speed of the contact roll 11 and, thus, also the surface speed of the package remain constant despite the increasing diameter of the latter.

An asynchronous motor may be substituted for the synchronous motor 29. In this event, the control frequencies are provided by a control signal, so that the nominal value of the spindle speed, which is respectively input by the controller 31, is exactly maintained. A suitable control system of this type is disclosed in DE-C 34 25 064.

The revolver 18 is rotatably supported in the frame 17 of the winding apparatus and rotated by the drive motor 33. As best seen in FIG. 2, the revolver includes a circular bearing surface 19 which defines a central axis, which corresponds to its rotational axis, and the revolver is supported by means of suitable antifriction bearings, for example, ball bearings 20 which are positioned between the surface 19 of the revolver and the machine frame. This type of bearing mount ensures the true running, an easy motion, and extended service life. In particular, it ensures that the central axis of the revolver is always parallel to the axis of the contact roll.

The drive motor 33 is operative on the revolver 18 via a coaxial shaft 23. The drive motor 33 serves to rotate the revolver in the direction of enlarging the spacing between the axes of the contract roll 11 and the spindle 5 as the package diameter increases.

Figure 7:
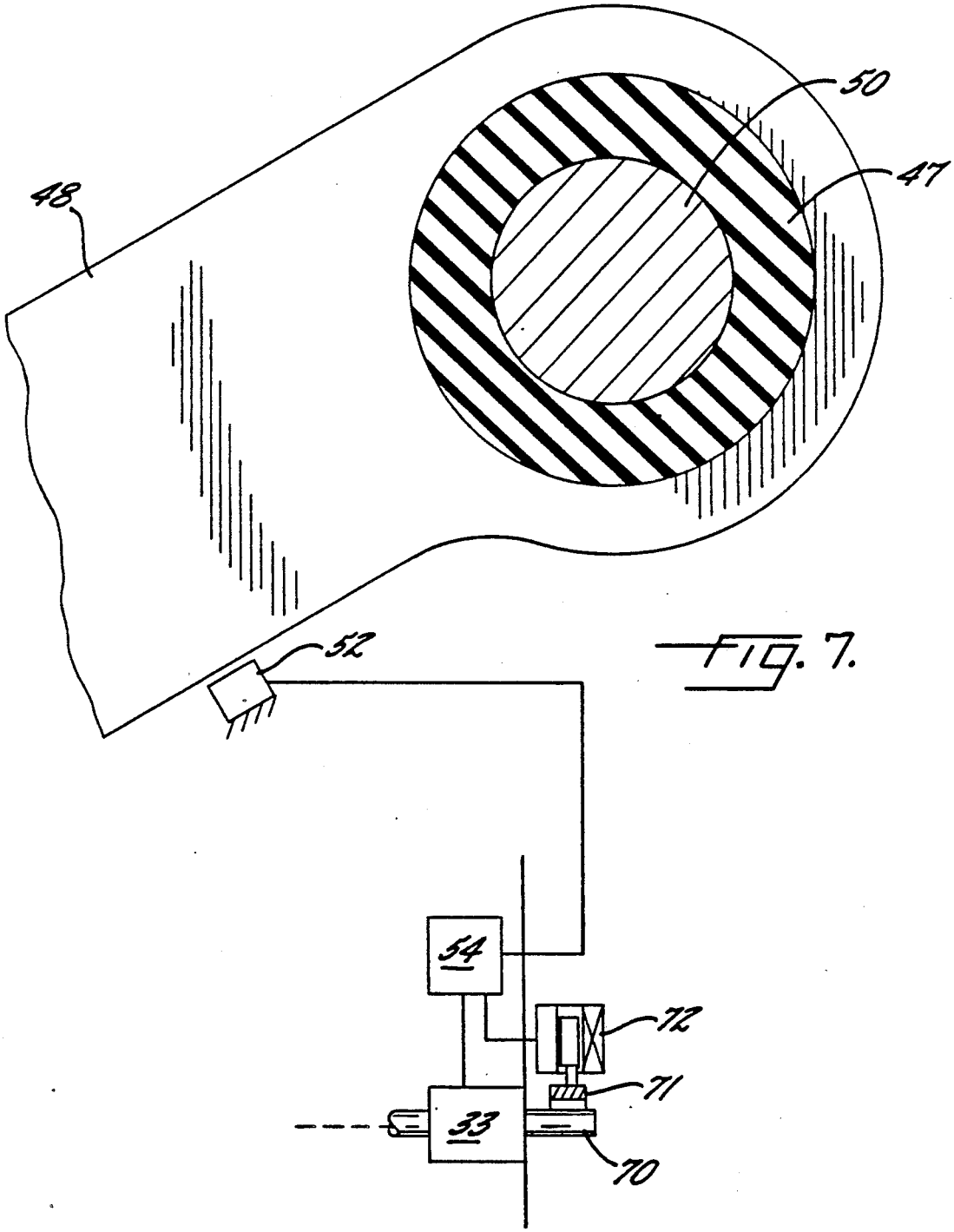
FIG. 7 is a detail view of the suspension of the guide means of the contact roll, and one embodiment of the drive motor for the revolver.

The revolver motor 33 may also be a braking motor. Such a braking motor has the characteristic that its rotor is immobilized, i.e., it is no longer rotatable, when the braking motor is not connected to a source of current. Such a motor 33, which is designed as a braking motor, is schematically illustrated in FIG. 7, which is a fragmentary view of a portion of FIGS. 3 and 4, and which shows the rotary drive and the rotational control means of the revolver 18. A brake 71 is applied to the shaft 70 of the motor 33 and turret 18. The brake 71 is actuated by an electromagnet 72. The electromagnet is connected with the rotational control device 54, and the rotational control device alternately closes either the rotor circuit of the motor 33 or the circuit of the electromagnet 72 of brake 71 as a function of an output signal of sensor 52, which scans the movement of the support arm 48 of the contact roll.

The motor 33 may alternatively be a stepping motor, which rotates continually at a very slow speed, and is controlled by the rotational control device as a function of an output signal from the sensor 52, which scans the movement of the support arm 48 of the contact roll in such a manner that the distance between the axes of the contact roll 11 and the spindle 5 is continuously increased as the package diameter increases.

The contact roll 11 is mounted on a support arm 48, so that it can perform a movement with a radial component with respect to the spindle. In the embodiments of FIGS. 1–4, the rocker arm 48 serves as a support for the contact roll, and the rocker arm 48 is supported by and pivots about the axis of a shaft 50 which is fixed to the frame of the apparatus. The axis of the shaft 50 is arranged in such a manner that the contact roll is movable with a radial component with respect to the spindle 5. The shaft 50 is supported by a rubber bushing 47, which is fixed to the frame of the apparatus. This rubber bushing accommodates the rocker arm 48, so that the latter can pivot in a rubber-elastic manner. An embodiment of such a bearing mount of the rocker arm is shown in detail in FIG. 7, wherein the rubber bushing 47 is a cylindrical tube, which is inserted into the annular space between the shaft 50 and the bearing sleeve of the rocker arm 48. The shaft 50 is thus fixedly supported on the machine frame, and the inner circumference of the rubber bushing is rigidly connected with the surface of shaft 50. The outer surface of the rubber bushing is fixedly connected with the inner surface of the sleeve of the rocker arm 48.

The rocker arm 48 permits the contact roll to give way to the increasing diameter of the package on the spindle in operating position by a very small distance of, for example, 2 mm.

As noted above, it is possible to use any one of the several known yarn traversing mechanisms. In the embodiments of FIGS. 1–4, the traversing mechanism is a so-called rotary blade type traversing system, comprising two rotors 12 and 13, which are interconnected by a gearing 22 and driven by a motor 14. Mounted on the rotors 12 and 13 are rotary blades 7 and 8, as can be seen in particular in FIGS. 2 and 3. The rotors rotate in different directions 27, 28, thereby guiding the yarn along a guide edge 9. In so doing, the one rotary blade assumes the guidance of the yarn in the one direction, and moves then below the guide edge, while the other rotary blade takes over the guidance in the other direction and moves then below the guide edge. The motor 14 is driven at a constant speed, but can also be controlled as a function of signals from a programmed controller.

Irrespective of the type of traversing mechanism, the housing thereof can be stationarily mounted. In the case of a stationary suspension of the traversing mechanism, the spacing between the contact roll 11 and the traversing yarn guide 40 varies, although the movements of the contact roll are very small and almost negligible.

In the embodiments of FIGS. 1–4, the yarn traversing mechanism 4 is movably supported on the frame of the winding apparatus. To this end, a rocker arm 49 is employed, the one free end of which mounts the traversing mechanism, whereas its other end is pivotally supported in such a manner that the traversing mechanism can perform a movement vertical to itself and to the contact roll, i.e., a parallel displacement.

In the embodiments of FIGS. 1–2, the rocker arm 49 is rotatably supported on the machine frame, with its axis of rotation being arranged substantially coaxially with the axis of rotation of shaft 50 of the rocker arm 48. Also, the rocker arm 49 for the traversing mechanism rests with a support 51 on the rocker arm 48 for the contact roll 11. As a result, the rocker arm 49 follows the movements of the arm 48. However, on the other hand, it can be independently raised, which is of a great advantage for servicing the contact roll and traversing mechanism. A cylinder-piston assembly 21, which is pneumatically biased and operative from the bottom on the rocker arm 48 allows to compensate in part or in whole for the weight, which bears on the contact roll and thus provides a contact pressure on the package. This load is the weight of the traversing mechanism and contact roll or only that of the contact roll, note FIGS. 5 and 6.

A sensor 52 is fixedly arranged on the apparatus frame of all embodiments. This sensor scans the movement of the rocker arm 48, in that it measures the spacing of the rocker arm 48 from the frame. As a function of an output signal, i.e., for example, when a predetermined spacing is exceeded, the sensor 52 emits an output signal, which is supplied to a controller 54 for the drive 33. The further operation will be described in greater detail below.

The operating method of the winding apparatus is identical for all embodiments, and is, with reference to FIGS. 1 and 2, as follows. FIG. 1 illustrates the winding spindle 5 in operation, at the beginning of the winding operation, only few layers are wound on the empty bobbin tube 10, and the contact roll 11 contacts the circumference of the package being formed. As the diameter of the package increases, the contract roll performs a slight radial movement. The distance of this movement is detected by the sensor 52. As a function of the output signal of the sensor 52, the motor 33 is governed by the controller 54 in such a manner that the revolver rotates by a small angle in a direction 56 so that the axial spacing between the contact roll and the spindle 5 is increased. The rotational direction of spindle 5 is indicated by arrow 55. Since the yarn loops anticlockwise about the contact roll, it will loop clockwise about the spindle 5 and the package being formed. Consequently, the spindle also rotates clockwise, and the revolver 18 does likewise in the direction 56.

For the control of the motor 33, the invention provides for two alternative methods. In a first embodiment, the motor 33 is a braking motor, as is shown in FIG. 7, and the shaft of the motor is first locked in position by the brake, so that the revolver can also no longer rotate, when the package diameter increases. As a result, the contact roll 11 is pushed out of its desired position to an actual position. A certain, allowable maximum value for the deviation between the actual position and the desired position of the contact roll is input into the controller 54. As soon as the distance sensor 52 detects that the deviation between the desired position and the actual position exceeds the input maximum value, the brake is released by the magnet, and the rotor of the motor 33 is simultaneously connected with its source of current. As a result, the motor is somewhat further rotated at a slow, but constant speed until the sensor 52 finds that the contact roll 11 has substantially reached again its desired position. The maximum value of the deviation which is allowed between the desired position and the actual position of the contact roll is very small and amounts to, for example, 1 mm. The motor 33 is then again stopped, and the brake is activated instead. As a result, the shaft of the motor 33 and thus also the revolver are again locked in a nonrotatable position.

In a second embodiment, the motor 33 is constantly connected to a source of current. The very low speed of the motor 33 is controlled by means of the distance sensor 52 and the rotational controlling device 54 in such a manner that the contact roll does not leave its desired position, or that the deviation between the actual and the desired position remains constant and as small as possible. This embodiment requires a motor 33, the rotational speed of which is not dependent on the torque. Consequently, in the case of this motor the pressure between the contact roll 11 and the winding spindle 5 or respectively the package formed thereon cannot lead to a rotation of the chuck in the first-mentioned embodiment, or respectively to an increase of the rotational speed of the chuck in the last-mentioned embodiment.

The end position of the package is indicated in dashed lines at 6, and the end position of the spindle in dashed lines at 5. It results therefrom that during a winding cycle the center of the winding spindle travels, as the turret is rotated, along a portion or the so-called operating range of the spindle turning circle. This operating range is indicated at 57 in FIG. 1. The greatest variation of the radial contact pressure occurs between the starting position, in which the spindle 5 is put in contact with the roll 11 for the first time, and that position, in which the axis of the spindle 5 lies on a tangent 58 extending from the center of the contact roll 11 to the operating range of the spindle turning circle. The angle alpha, by which the center of the winding spindle 5 travels relative to the center of the contact roll 11, should be as small as possible. In FIG. 1, this angle is exaggerated, so as to obtain a better illustration in the drawing. In reality, this angle is substantially smaller, preferably less than 15°. The special advantage of the invention is that the variation of the contact pressure can be kept small, even at a low diameter ratio (which is defined as the diameter of the empty tube to diameter of the full package) of less than 1:3, and even when the looping angle of the yarn on the contact roll 11 is greater than 90°. Another advantage can be found in that, as is shown in FIG. 1, the looping angle increases rather than decreases on the contact roll as the package diameter becomes larger. A decrease of the looping angle would result in a greater slip of the yarn on the contact roll. An increase of the slip will lead to a change of the yarn tension, in particular, when the contact roll is driven, or driven with an output greater than the idling output for the purpose of decreasing the yarn tension, note DE-OS 35 13 796.

A still further advantage is that the contact pressure starts from a relatively low value and increases during a winding cycle and especially at the beginning thereof. This considers the circumstance that the contact pressure should be relatively low when winding the first layers, and increase later.

These advantages result in particular from the fact that, aside from variations, which are insignificant from the viewpoint of the winding technology, the position of the contact roll remains essentially unchanged during the winding cycle. Nonetheless, however, the contact pressure is exerted by the mobility of the contact roll and the force being applied thereto, in contrast to the known winding machines, in which the contact pressure is applied by the torque operative on the revolver, and therefore largely dependent on the relative position between the winding spindle and the contact roll.

Figure 5:
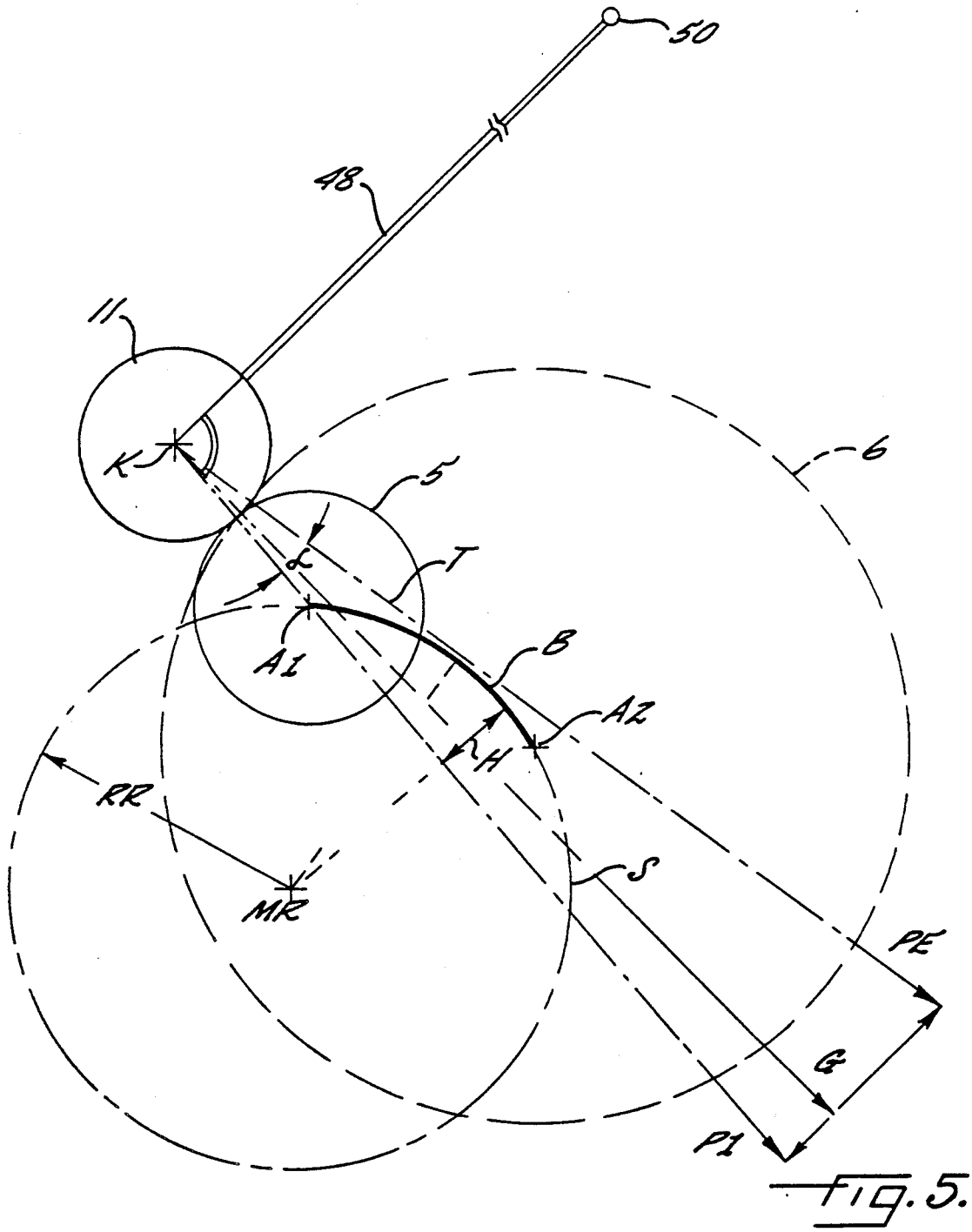
FIGS. 5 and 6 are diagrams showing the course of the contact pressure between the contact roll and the package.
Figure 6:
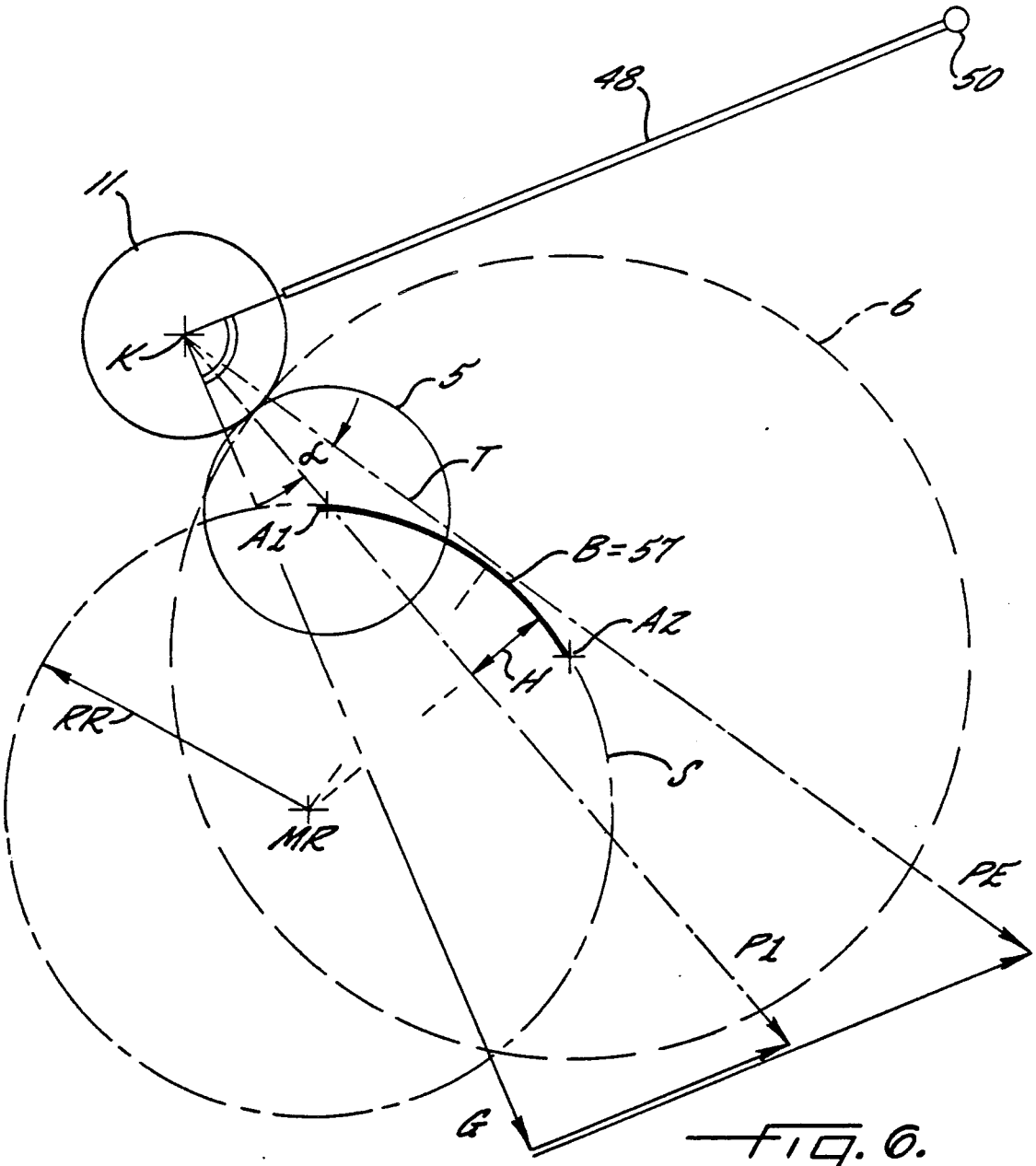

FIGS. 5 and 6 further illustrate the pertinent features of the present invention with regard to the layout of the winding machine for the purpose of minimizing the fluctuation of the pressure between the contact roll and package. FIGS. 5 and 6 show the cross sectional geometry of the winding machine with the contract roll 11, the winding spindle 5 at the beginning of a winding cycle, the full package 6 at the end of the winding cycle, and the operating range B of the spindle turning circle S, which is described by the revolver with the axis of the winding spindle. During a winding cycle, the axis of the winding spindle moves between the points A1 and A2 on the spindle turning circle S. The section between the points A1 and A2 is here indicated as the operating range B, and at 57 in FIG. 1. Further illustrated, in a different geometric position, is the rocker arm 48, on which the contact roll 11 is rotatably supported, as well as the axis of shaft 50 about which the rocker arm pivots.

The pressure under which the contact roll 11 rests on the package has the direction of the connecting line between the center K of the contact roll 11 and the axis A of the winding spindle. A first extreme direction extends through the points K and A1, i.e., the position of the axis of the winding spindle at the beginning of a winding cycle. A second extreme direction is the tangent from the axis K to the operating range B of the spindle turning circle S. As can be noted from both FIG. 5 and FIG. 6, the line of application of the force G, which is exerted by the contact roll, is the direction of guidance of the contact roll, i.e., the perpendicular to the rocker arm 48 at the point K. At the beginning of a winding cycle, this force G is resolved to a starting contact pressure P1, which extends through the initial position A1 of the spindle axis, and a force parallel to the rocker arm 48. In the extreme case, the force G is again resolved to the parallel force of the rocker arm 48 and the extreme contact pressure PE, which is operative on the tangent T.

As can again be noted from FIGS. 5 and 6, the difference between the initial force P1 and the extreme force PE is relatively small, since the arc, which the initial direction of the force P1 (connecting line between K and A1) cuts off from the spindle turning circle S, has only a small height H. Decisive therefor are the relative position of the center MR of the turret, the radius RR of the spindle turning circle S as well as the position of the contact roll 11 and the starting position A1 of the winding cycle.

FIG. 5 also shows that the difference between the initial contact pressure P1 and the most extreme contact pressure PE can be further reduced, when the guiding direction of the contact roll 11, which is predetermined by the position of the pivot shaft 50, is so placed that the guiding direction or respectively the direction of force G intersects the operating range B of the spindle turning circle S. In such a particularly favorable geometric layout, the contact pressure slightly decreases at first during a winding cycle until it has precisely the value of the effective force G. Then, the contact pressure slightly increases up to the extreme value PE, and subsequently decreases again. For this reason, this geometric layout is especially preferred.

Figure 4:
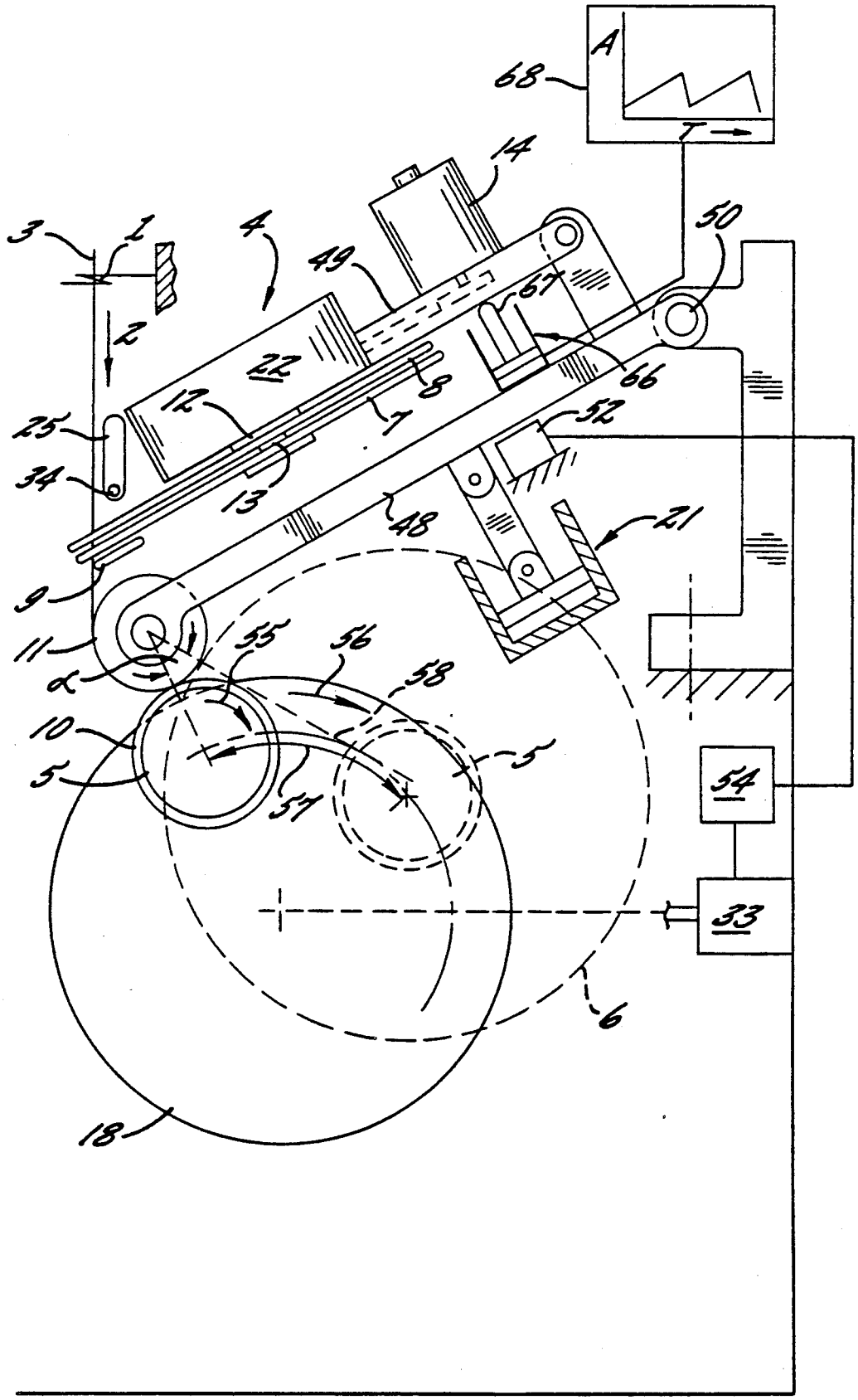

As to the method of traversing the yarn, reference is made to the embodiments of FIGS. 1, 3 and 4, which show that the traversing mechanism 4 is movably supported on the rocker arm 49 in such a manner that the spacing between the traversing mechanism and contact roll 11 is variable.

In the embodiment of FIG. 1, the smallest distance between the traversing mechanism and the contact roll 1, which is maintained during a winding cycle, is predetermined by the stop 51. This means that the spacing is not varied during a winding cycle. However, the distance can be increased, when the winding machine needs to be serviced.

In the embodiments of FIGS. 3 and 4, a position control means is provided which allows the spacing between the traversing mechanism 4 and the contact roll 11 to be varied during a winding cycle. The position control means comprises a pneumatic cylinder-piston assembly 66, which includes a rod 67 which engages the rocker arm 49. In the embodiment of FIG. 3, the cylinder is supported in the machine frame and in the embodiment of FIG. 4 it is supported on the rocker arm 48 of the contact roll. The position control means also comprises primarily a programmed controller 68, which controls the pressure in the assembly 66 according to a predetermined program. As further described in the above referenced copending application Ser. No. 07/454,723, a stroke modification program may be input as such a program, and wherein the traverse stroke is periodically shortened and lengthened by varying the spacing between the traversing mechanism and the contact roll 11 during the winding operation.

Figure 8:
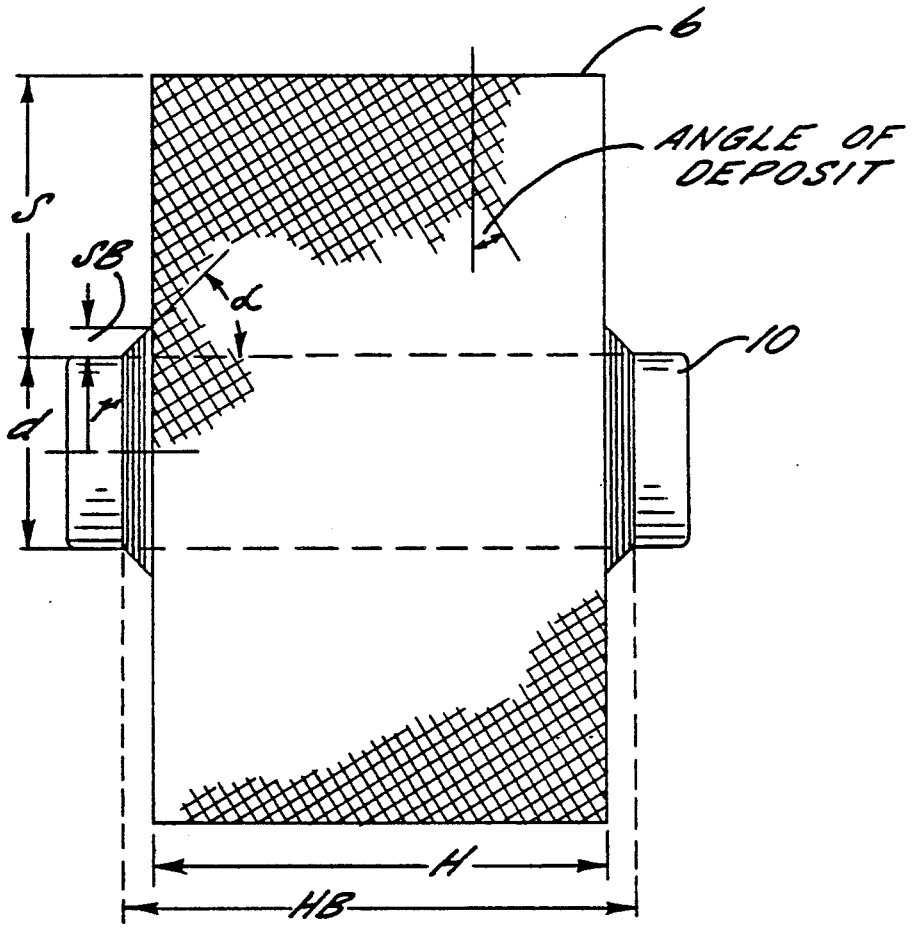
FIG. 8 is a front elevation view of a package produced by the winding apparatus.
Figure 9:
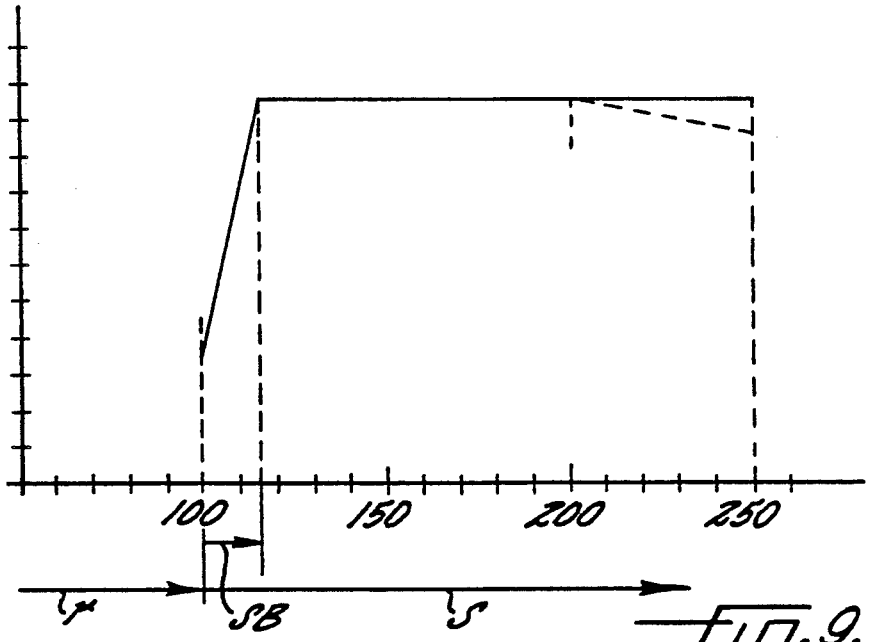
FIG. 9 is a graph illustrating the program for varying the spacing between the yarn traversing system and the contact roll.

The stroke may be modified in accordance with a predetermined program, and whereby the spacing between the traversing mechanism and the contact roll is continuously increased and decreased. Other programs may be utilized. One of such programs results, for example, from the object of producing a package, as is illustrated in FIG. 8 and disclosed in the U.S. Pat. No. 4,789,112. According to such a program, the spacing between the traversing mechanism and the contact roll, as is shown in FIG. 9, is increased at the beginning of a winding cycle and then kept constant. In the period of time in which the spacing is increased, a basic layer of no more than 10% of the entire layer thickness of the package is to be achieved. The period of time in which the spacing between the traversing mechanism and the contact roll remains constant, should be adequate so as to build up at least 80% of the entire diameter of the package. Subsequently, the spacing may again be decreased, as indicated by the dashed lines in FIG. 9.

In FIGS. 8 and 9, r is the radius of the empty tube, S the thickness of the layer, SB the thickness of the basic layer, HB is the overall length of the package, and H is the length of the cylindrical portion of the package.

If this program is followed, a package will form which has a slightly conical basic layer on its two front ends, as indicated by the angle alpha in FIG. 8. Otherwise, the package will be cylindrical. The spacing may be varied slightly so that the length variation of the basic layer is barely noticeable and is effective only by an improved, primarily more stable support for all layers of the package.

Once the full package has reached its end position 6, it has to be replaced by an empty bobbin tube. The method is described below with reference to FIGS. 10 and 11.

In the illustrated embodiments, the apparatus includes a yarn lifting device 25 which is shown rotated by 90° in FIGS. 1–4 and which has an axis of rotation 34 extending parallel to the direction of the yarn traverse, the axis of the contact roll and the axis of the winding spindle. Its V-shaped front edge 35 intersects with its two legs the axis of rotation 34 and forms in its moved-out position (FIGS. 10 and 11) two guide edges extending obliquely to the yarn traversing mechanism and converging a guide notch 36. The guide notch 36 first extends in a plane which is normal to the winding spindle and which lies within the traverse stroke. However, the yarn lifting device can be displaced along its axis of rotation 34 in the direction of arrow 45, until the guide notch 36 lies in a normal plane in which the winding tube 10 has a yarn catching slot 37 as indicated in FIG. 2. In the present application, this normal plane is described as the yarn catching plane. The catching slot is a narrow notch formed in the surface of the winding tube which extends over a portion of the entire circumference and may have a special shape which is described, for example, in copending application, Ser. No. 07/454,723. It should be mentioned that the yarn catching slot 37 is located outside of the traverse stroke H over which the tube normally is wound.

Figure 10:
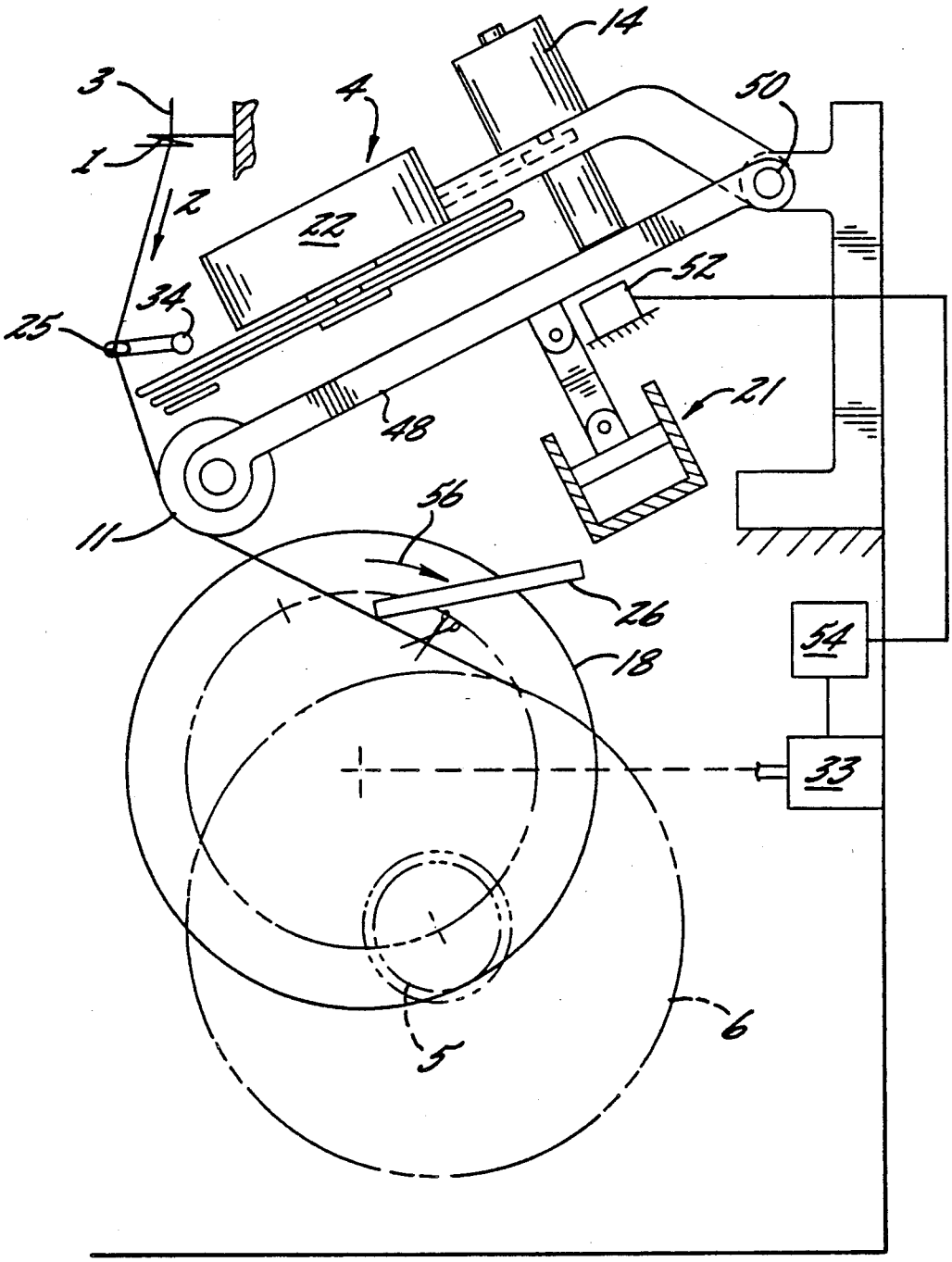
FIGS. 10 and 11 are views similar to FIG. 1 and illustrating a preferred embodiment of the package doffing process.
Figure 11:
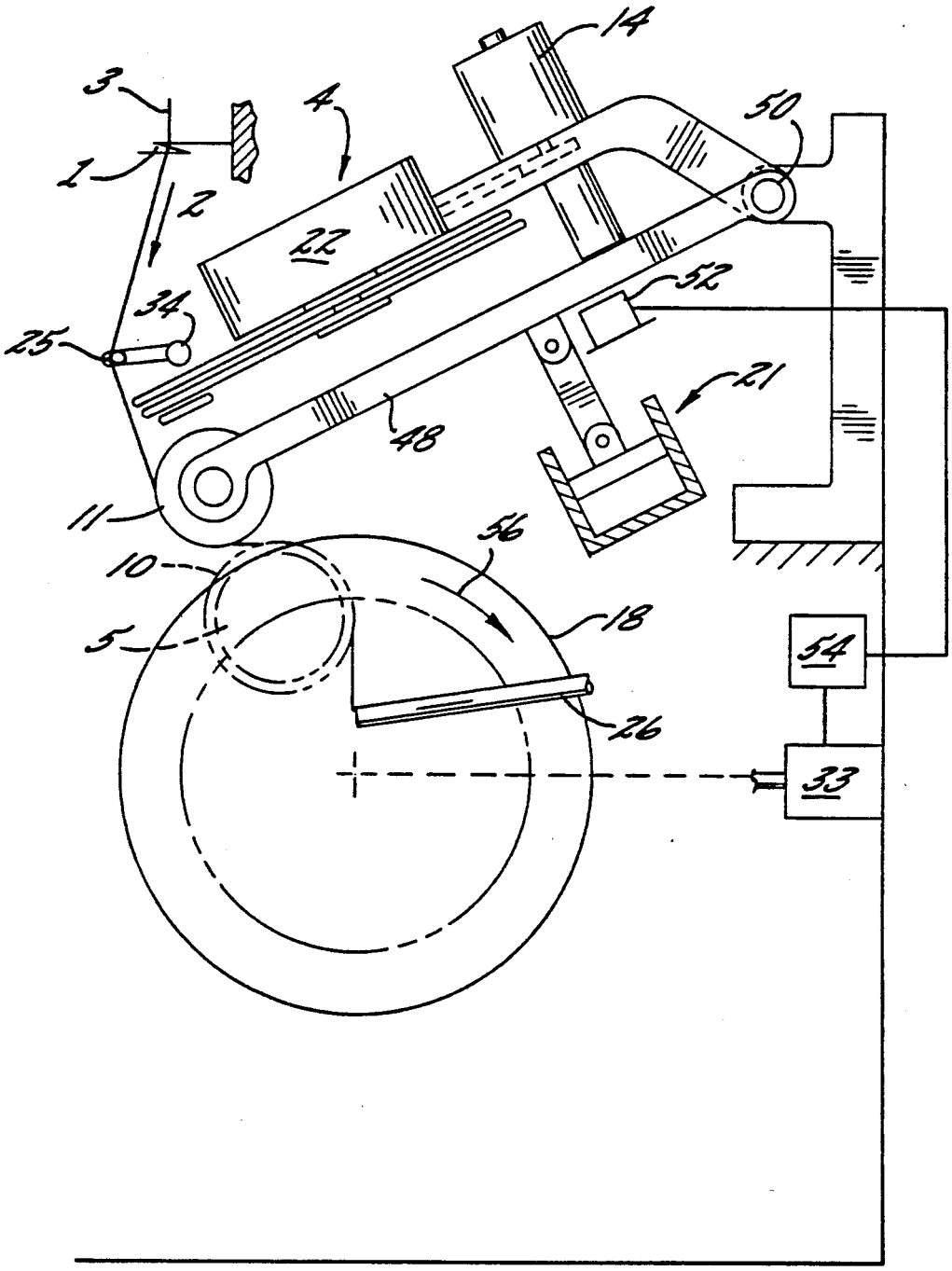

For the purpose of transferring the yarn, the yarn lifting device 25 is pivoted forwardly. By this pivotal motion of the yarn lifting device 25, the yarn is removed as shown in FIGS. 10 and 11 from the contact zone of the rotary blades 7, 8 of the traversing mechanism 4 to such an extent that there is no longer any contact. Consequently, the yarn slides along one of the oblique edges 35 and enters into the notch 36. At the same time as the yarn lifting device is pivoted, a yarn removing device 26 is transferred into the thread line between contact roll 11 and full package 6. The full package has meanwhile been brought by rotation of revolver 18 into the doffing position as indicated in FIG. 10. The yarn removing device may be a conventional suction gun which is maneuvered by hand and may also be a device as shown in U.S. Pat. No. 4,817,880, or any other means capable of removing and putting to waste a continuously high speed running yarn.

By the action of the yarn removing device, the yarn is severed between contact roll 11 and full package 6 and now runs continuously to the yarn removing device. Now, the full package 6 is braked, and the bobbin with the full package 6 may be doffed from the spindle and replaced by an empty bobbin tube.

Now, the revolver 18 is further rotated in the directional sense of arrow 56 to the position close to the contact roll 11 as shown in FIG. 11, while the rotational movement of the spindle is restarted again. Thereby the empty bobbin tube gets into contact with the thread line between contact roll 11 and the yarn removing device 26 in such a way that the bobbin tube is partly embraced by the yarn. At this point of time, the yarn lifting device 25 is displaced towards the package end in which the catching slot is located, i.e. in the direction of arrow 45, until the guide notch 36 lies substantially in the normal plane in which the yarn slot 37 in the empty tube 10 is also located. While the yarn lifting device 25 performs this movement in the direction of arrow 45, the yarn is further transferred into the yarn removing device. On the other hand, the yarn is advanced by the notch 36 to the area of the catching slot in the empty tube 10, assisted by the contact roll 11 which is preferably driven during the yarn catching operation and consequently exerts a tension on the yarn. Here, it should be noted that the yarn removing device is brought to a position such that the yarn turns around the empty bobbin tube by as large an angle as possible.

Thereby the yarn is firmly clamped in the catching slot, so that it cannot leave the catching slot and ruptures, if the denier of the yarn is low. If not so, a yarn cutter which is attached to the yarn removing device may be actuated at this moment.

After the yarn being cut, the yarn end caught in the notch is wound onto the empty tube of the winding spindle 5. Then the yarn lifting device 25 returns to its inoperative position and the yarn removing device is withdrawn. Consequently, the yarn again is caught by the traversing mechanism 4 and reciprocated. As a result, the first layers of a package are formed on the empty tube. The gap between the package to be formed on the contact roll remains for the time being. This means that the spindle 5 now in operation must be driven without the circumferential speed of the forming package being regulated. Consequently, it is necessary to drive the winding spindle at a constant speed, the speed being so predetermined that the circumferential speed of the empty tube and the first yarn layers have a value required for obtaining the yarn speed. However, during the time in which the contact roll does not rest against the forming package, the revolver 18 is also out of operation, i.e. the revolver 10 is stopped.

Two methods are possible to re-establish the rotational drive of the revolver 18. According to a first embodiment, a suitable time is programmed in a controller and predetermined by same. This time is predetermined in consideration of the following winding technological aspects. While the first layers of yarn are wound, the package is very hard. Consequently, upon the contact of the contact roll with the first yarn layers, the risk will be incurred that the yarn layers are damaged. After the predetermined time has elapsed, the controller restarts the rotational drive of the revolver in that the pressure in the pressure relief device 21 is again decreased to an amount as is desired in the normal operation. As a result, the contact roll lowers again until it rests on the package. The sensor 52 now functions again and controls the rotational drive of the revolver 18 as a function of the monitored movements of the contact roll.

According to a second possible embodiment, as many yarn layers are wound on the empty tube 10 of the winding spindle 5 now in operation as are needed to make the developing package engage with the contact roll, thereby causing a deviation on the rocker arm 48, which is detected by the sensor 52. The output signal is now also used to reduce again the pressure in the pressure relief device 21 to the amount desired for the normal operation.

As aforesaid, a first reason for raising the contact roll from the empty tube 10 and winding spindle 5 now in operation is to doff the package from the winding spindle 5.

In addition, the present invention offers the possibility of predetermining the force at which the contact roll rests on the package, and of programming same during the winding cycle in such a manner as is desirable or necessary from the winding technological viewpoint. If a constant contact force is desired, the pressure relief device will be biased with a slight pressure during the winding operation after the contact between the contact roll and the forming package is made, which pressure remains constant and serves to compensate for a portion of the total weight of the rocker arm 48 and the contact roll as well as the traversing mechanism, so as to adjust the contact force, which is exerted by the contact roll on the package, to the correct amount. However, as aforesaid, it is also possible to control the pressure in such a manner that a predetermined variation of the contact force is achieved during a winding cycle.

In the drawings and specification, there has been set forth a preferred embodiment of the invention, and although specific terms are employed, they are used in a generic and descriptive sense only and not for purposes of limitation.

That which is claimed is:

1. An apparatus for continuously winding an advancing yarn onto bobbin tubes serially delivered to a winding position, and comprising a frame, a revolver having a circular bearing surface which defines a central axis, said revolver mounting at least one winding spindle which is adapted to mount at least one bobbin tube thereon and which defines a winding axis which is parallel to and radially spaced from said central axis, and with said circular bearing surface being located radially beyond said winding axis, means mounting said revolver to said frame for rotation about said central axis and such that said at least one winding spindle and associated at least one bobbin tube may be selectively moved between a winding position and a doffing position upon rotation of said revolver, said mounting means including bearing means positioned between said circular bearing surface and said frame, rotary drive means for rotating said revolver in response to the build of a package upon said at least one bobbin tube, and means for winding an advancing yarn onto said at least one bobbin tube at the winding position and including means for rotating said at least one winding spindle and associated at least one bobbin tube at the winding position, and traversing means mounted at a location upstream of the winding position for traversing an advancing yarn to form a cross wound package.

2. The apparatus as defined in claim 1 further comprising a contact roll, means mounting said contact roll to said frame at a location between said traversing means and the winding position and so as to be in circumferential contact with the package being wound, and so as to permit limited movement of said contact roll in a radial direction away from the package being wound at the winding position, sensor means for monitoring the radial movement of said contact roll and providing an output signal in response thereto, and said rotary drive means including means for selectively rotating said revolver to move said at least one winding spindle between said winding position and said doffing position, and for causing rotation of said revolver in response to said output signal from said sensor means so as to increase the distance between the axis of said contact roll and the axis of said at least one winding spindle at said winding position as the package builds and so that the positioning of said contact roll remains within a predetermined range during the course of the winding operation.

3. The winding apparatus as defined in claim 2 wherein said rotary drive means acts to rotate said revolver in the same rotational direction as that of said at least one winding spindle, and with said contact roll being positioned so that the advancing yarn loops about the contact roll by an angle of at least about 60 degrees in a first direction and then loops about the package being wound in the opposite direction.

4. The winding apparatus as defined in claim 3 wherein a contact plane is defined by the axis of said contact roll and the axis of said revolver, and said at least one winding spindle at said winding position is located on the side of said contact plane toward which the yarn advancing from said contact roll is directed.

5. The winding apparatus as defined in claim 4 wherein an initial line of force (P1) is defined as a line between the axis of the contact roll and the axis of said at least one winding spindle at the winding position at the beginning of the winding operation, and a spindle turning circle (S) is defined by the rotational movement of the axis of said at least one winding spindle upon rotation of said revolver, and wherein said initial line of force forms a secant to said spindle turning circle.

6. The winding apparatus as defined in claim 5 wherein an extreme line of force (PE) is defined which extends from the axis of the contact roll and is tangent to said spindle turning circle, and wherein the angle between said initial line of force and said extreme line of force is less than about 20 degrees.

7. The winding apparatus as defined in claim 2 wherein said means mounting said contact roll permits the same to rest upon the surface of the package being wound with a gravitational force component, and said mounting means includes pressure control means for at least partially compensating for such gravitational force component.

8. The winding apparatus as defined in claim 7 wherein said pressure control means is controllable to maintain a predetermined force between the contact roll and the surface of the package being wound during the course of the winding operation.

9. The winding apparatus as defined in claim 7 wherein said pressure control means includes means for selectively lifting said contact roll from the surface of said at least one bobbin tube on said at least one winding spindle at said winding position at the beginning of the winding operation.

10. The winding apparatus as defined in claim 2 wherein said means mounting said contact roll includes a rocker arm, pivotal mounting means pivotally mounting one end of said rocker arm to said frame of said apparatus, and with said contact roll being mounted at the other free end of said rocker arm.

11. The winding apparatus as defined in claim 10 wherein said pivotal mounting means includes a shaft, a sleeve coaxially mounted about said shaft, and an elastic bushing interposed between said shaft and said sleeve.

12. The winding apparatus as defined in claim 10 wherein said traversing means comprises a traversing mechanism, and means mounting said traversing mechanism such that a substantial portion of the weight thereof is applied to said rocker arm.

13. The winding apparatus as defined in claim 12 wherein said pivotal mounting means of said rocker arm includes a shaft mounted to said frame of said apparatus, a sleeve fixed to said one end of said rocker arm and coaxially mounted upon said shaft, and wherein said means mounting said traversing mechanism includes a second rocker arm.

14. The winding apparatus as defined in claim 13 wherein said means mounting said traversing mechanism further includes spacing control means for maintaining a minimum spacing between said traversing mechanism and said contact roll.

15. The winding apparatus as defined in claim 13 wherein said second rocker arm is pivotally mounted to said shaft and so as to be independent of the pivotal movement of said first mentioned rocker arm about said shaft.

16. The winding apparatus as defined in claim 13 wherein said means mounting said traversing mechanism includes programmed control means by which the spacing between said traversing mechanism and said contact roll may be controlled through the entire course of the winding operation in accordance with a predetermined program.

17. The winding apparatus as defined in claim 2 wherein said rotary drive means includes means for positively rotating said revolver when said output signal from said sensor means indicates said contact roll is beyond said predetermined range of movement, and for braking the rotation of said revolver when said contact roll is not beyond said predetermined range of movement.

18. The winding apparatus as defined in claim 2 wherein said rotary drive means includes means for positively rotating said revolver substantially continuously during the entire winding operation and so as to maintain the movement of said contact roll within said predetermined range of movement.

19. A method for continuously winding a high speed continuously advancing yarn onto bobbin tubes which are serially delivered to a winding position, and wherein the bobbin tubes are adapted to be coaxially mounted on a winding spindle which is in turn rotatably mounted on a rotatable revolver, with the spindle having a winding axis which is parallel to and radially spaced from the axis of the revolver, and comprising the steps of winding the advancing yarn onto a first bobbin tube positioned on said winding spindle which is located at an initial winding position, and including (a) traversing the yarn at a location upstream of the winding position to form a cross wound package on the bobbin tube, while (b) engaging the surface of the package being formed with a contact roll, with the contact roll being mounted for limited movement in a radial direction away from the package as the package builds, and (c) sensing the movement of the contact roll and rotating the revolver so as to laterally move the package being formed and thereby increase the radial distance between the package and the contact roll, and so as to maintain the positioning of the contact roll within a predetermined narrow range of movement during the course of the winding operation, separating the rotating first bobbin tube from the contact roll upon the first bobbin tube becoming full, catching and continuously engaging the advancing yarn by a yarn removing means, removing the full first bobbin tube from said spindle and replacing the same with an empty second bobbin tube, rotating the revolver so as to return said spindle and empty second bobbin tube to said initial winding position, rotating the empty second bobbin tube and transferring the advancing yarn from the yarn removing means to the rotating second bobbin tube and so that the yarn is wound thereupon, and repeating steps (a), (b), and (c) so as to form a cross wound package on the second bobbin tube.

20. The method as defined in claim 19 wherein the revolver has a circular bearing surface which defines a central axis about which the revolver is rotated, and with the circular bearing surface being located radially beyond the winding axis of the said spindle, and wherein the step of rotating the revolver includes supporting the same with bearing means positioned upon said circular bearing surface.

21. The method as defined in claim 19 wherein the step of rotating the revolver so as to return said spindle and empty second bobbin tube to said initial winding position includes supporting the contact roll so that a spaced relationship is formed between the contact roll and the empty bobbin tube.

22. The method as defined in claim 21 including maintaining the spaced relationship between the contact roll and the empty bobbin tube until after the yarn transferring step has been completed, and such that the sensing step is inoperative until contact between the contact roll and the empty bobbin tube is established.

23. The method as defined in claim 22 wherein contact between the contact roll and the empty bobbin tube is initially established by reason of the build of the package on the empty bobbin tube, and wherein the sensing step thereafter becomes operative.

24. The method as defined in claim 19 including the further step of positively rotating the contact roll when it is not in contact with a bobbin tube or the package formed thereon.

* * * * *